US011635194B2

(12) United States Patent
Winans et al.

(10) Patent No.: US 11,635,194 B2
(45) Date of Patent: Apr. 25, 2023

(54) FASTENERLESS HOLDER FOR CONNECTING AN ELECTRICAL COMPONENT TO A PRINTED CIRCUIT BOARD

(71) Applicant: GHSP, Inc., Holland, MI (US)

(72) Inventors: Emily Winans, Spring Lake, MI (US); Lee Karner, Holland, MI (US); Andrew VanTimmeren, Nunica, MI (US); Ryan Mass, Grand Haven, MI (US); Samuel Wachowski, Grand Haven, MI (US)

(73) Assignee: GHSP, Inc., Holland, MI (US)

( * ) Notice: Subject to any disclaimer, the term of this patent is extended or adjusted under 35 U.S.C. 154(b) by 0 days.

(21) Appl. No.: 17/223,603

(22) Filed: Apr. 6, 2021

(65) Prior Publication Data

US 2021/0317974 A1 Oct. 14, 2021

Related U.S. Application Data

(60) Provisional application No. 63/007,024, filed on Apr. 8, 2020.

(51) Int. Cl.
*F21V 23/00* (2015.01)
*F21V 21/088* (2006.01)
(Continued)

(52) U.S. Cl.
CPC ..... *F21V 23/005* (2013.01); *F21V 21/088* (2013.01); *F21V 19/0025* (2013.01);
(Continued)

(58) Field of Classification Search
CPC ..... F21V 19/0025; F21V 19/0085; H01R 4/4809; H01R 4/4818; H01R 12/7076; H01R 13/111; H01R 13/15; H01R 13/193
See application file for complete search history.

(56) References Cited

U.S. PATENT DOCUMENTS 3,633,149 A * 1/1972 Maltais ..... F21V 19/0005 439/612
4,472,018 A * 9/1984 Urani ..... H01H 85/205 439/814
(Continued)

FOREIGN PATENT DOCUMENTS

EP 2654127 A1 * 10/2013 ..... H01R 4/4809
KR 100833461 B1 * 5/2008 ..... H01R 33/08
(Continued)

OTHER PUBLICATIONS

Machine Translation of KR 100833461 B1 retrieved from the FIT database of PE2E search. (Year: 2022).*
(Continued)

*Primary Examiner* — Colin J Cattanach
(74) *Attorney, Agent, or Firm* — Price Heneveld LLP

(57) ABSTRACT

An electrical element holder includes a printed circuit board having a receiver. A resilient holder is electrically engaged with the receiver. The resilient holder includes a holding portion that is defined within an outward surface of the resilient holder and between opposing resilient arms. An electrical element is secured within the holding portion between the opposing resilient arms.

20 Claims, 3 Drawing Sheets

(51) Int. Cl.

| | |
|---|---|
| ***H01R 33/02*** | (2006.01) |
| ***F21V 19/00*** | (2006.01) |
| ***H01R 13/15*** | (2006.01) |
| ***H01R 4/48*** | (2006.01) |
| ***H01R 12/70*** | (2011.01) |
| ***H01R 13/11*** | (2006.01) |
| ***H01R 13/193*** | (2006.01) |

(52) U.S. Cl.
CPC ..... *F21V 19/0085* (2013.01); *H01R 4/4809* (2013.01); *H01R 4/4818* (2013.01); *H01R 12/7076* (2013.01); *H01R 13/111* (2013.01); *H01R 13/15* (2013.01); *H01R 13/193* (2013.01); *H01R 33/02* (2013.01)

(56) References Cited

U.S. PATENT DOCUMENTS 4,547,036 A * 10/1985 Keglewitsch ..... H01H 85/24 439/842
4,950,195 A * 8/1990 Perreault ..... H01H 85/20 439/830
5,609,410 A * 3/1997 Rives ..... B60Q 3/225 362/255
5,879,203 A * 3/1999 Egle ..... H01H 85/202 439/739
6,099,322 A * 8/2000 Beloritsky ..... H01R 13/111 439/83
6,273,587 B1 * 8/2001 Demshki ..... F21S 4/20 362/235
6,309,236 B1 * 10/2001 Ullrich ..... H01J 5/54 439/226
7,607,791 B2 * 10/2009 Yoo ..... G02F 1/133608 362/225
7,810,943 B2 * 10/2010 Ko ..... G02F 1/133604 362/225
7,824,202 B1 * 11/2010 Bria ..... F21V 19/008 439/234
8,057,065 B2 * 11/2011 Park ..... G02F 1/133604 362/225
8,120,725 B2 * 2/2012 Kim ..... G02F 1/133604 349/61
8,979,600 B2 * 3/2015 von zur Muehlen .. H01H 85/48 439/833
2007/0183149 A1 * 8/2007 Ko ..... G02F 1/133604 362/225
2008/0102711 A1 * 5/2008 Yang ..... H01R 33/02 439/660
2008/0112169 A1 * 5/2008 Cunius ..... F21V 21/002 362/249.07
2009/0191741 A1 * 7/2009 Cho ..... H01R 33/02 439/232
2009/0215292 A1 * 8/2009 Rueggen ..... H01R 4/4827 439/83
2010/0173540 A1 * 7/2010 Lee ..... F21V 19/0085 439/861

FOREIGN PATENT DOCUMENTS

WO WO-9731409 A1 * 8/1997 ..... H01R 33/09
WO WO-2007148445 A1 * 12/2007 ..... G02F 1/133604

OTHER PUBLICATIONS

Machine Translation of WO 2007148445 A1 retrieved from the FIT database of PE2E search. (Year: 2022).*
Machine Translation of EP 2654127 A1 retrieved from the FIT database of PE2E search. (Year: 2022).*

* cited by examiner

FASTENERLESS HOLDER FOR CONNECTING AN ELECTRICAL COMPONENT TO A PRINTED CIRCUIT BOARD

CROSS-REFERENCE TO RELATED APPLICATION

This application claims priority to and the benefit under 35 U.S.C. § 119(e) of U.S. Provisional Patent Application No. 63/007,024, filed on Apr. 8, 2020, entitled FASTENERLESS HOLDER FOR CONNECTING AN ELECTRICAL COMPONENT TO A PRINTED CIRCUIT BOARD, the entire disclosure of which is hereby incorporated herein by reference.

FIELD OF THE INVENTION

The present invention generally relates to electrical connectors, and more specifically, electrical connectors that include a resilient holder for receiving an electrical component, such as a light bulb, in a manner that is free of additional fasteners.

BACKGROUND OF THE INVENTION

Light bulbs and other electrical fixtures are included within many settings and applications. Conventional connections for these fixtures typically require the use of external fasteners or adapters that must be attached in order to provide a physical connection, electrical connection, or both.

SUMMARY OF THE INVENTION

According to a first aspect of the present disclosure, an electrical element holder includes a printed circuit board having a receiver. A resilient holder is electrically engaged with the receiver. The resilient holder includes a holding portion that is defined within an outward surface of the resilient holder and between opposing resilient arms. An electrical element is secured within the holding portion between the opposing resilient arms.

According to a second aspect of the present disclosure, an electrical element holder includes a printed circuit board having an element receptacle. Opposing resilient holders are positioned at each end of the element receptacle. Each of the opposing resilient holders is electrically attached with the printed circuit board at respective receivers. Each resilient holder of the opposing resilient holders includes a holding portion defined within an outward surface of opposing resilient arms of each resilient holder. The holding portion is further defined between the opposing resilient arms. An electrical element is secured within the holding portion between the opposing resilient arms for each resilient holder. The opposing resilient arms at the holding portion selectively receive the electrical element and prevent movement of the electrical element below the holding portion.

According to a third aspect of the present disclosure, an element receptacle includes a printed circuit board having a receiver. A resilient holder is electrically engaged with a portion of the receiver. The resilient holder includes a holding portion that is defined within an outward surface of the resilient holder and between opposing resilient arms. An inward surface defines a biasing space. An electrical element is secured within the holding portion between the opposing resilient arms. The opposing resilient arms operate to selectively expand the holding portion from a rest position to a maintenance position. The opposing resilient arms encircle the biasing space in each of the rest position and the maintenance position.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
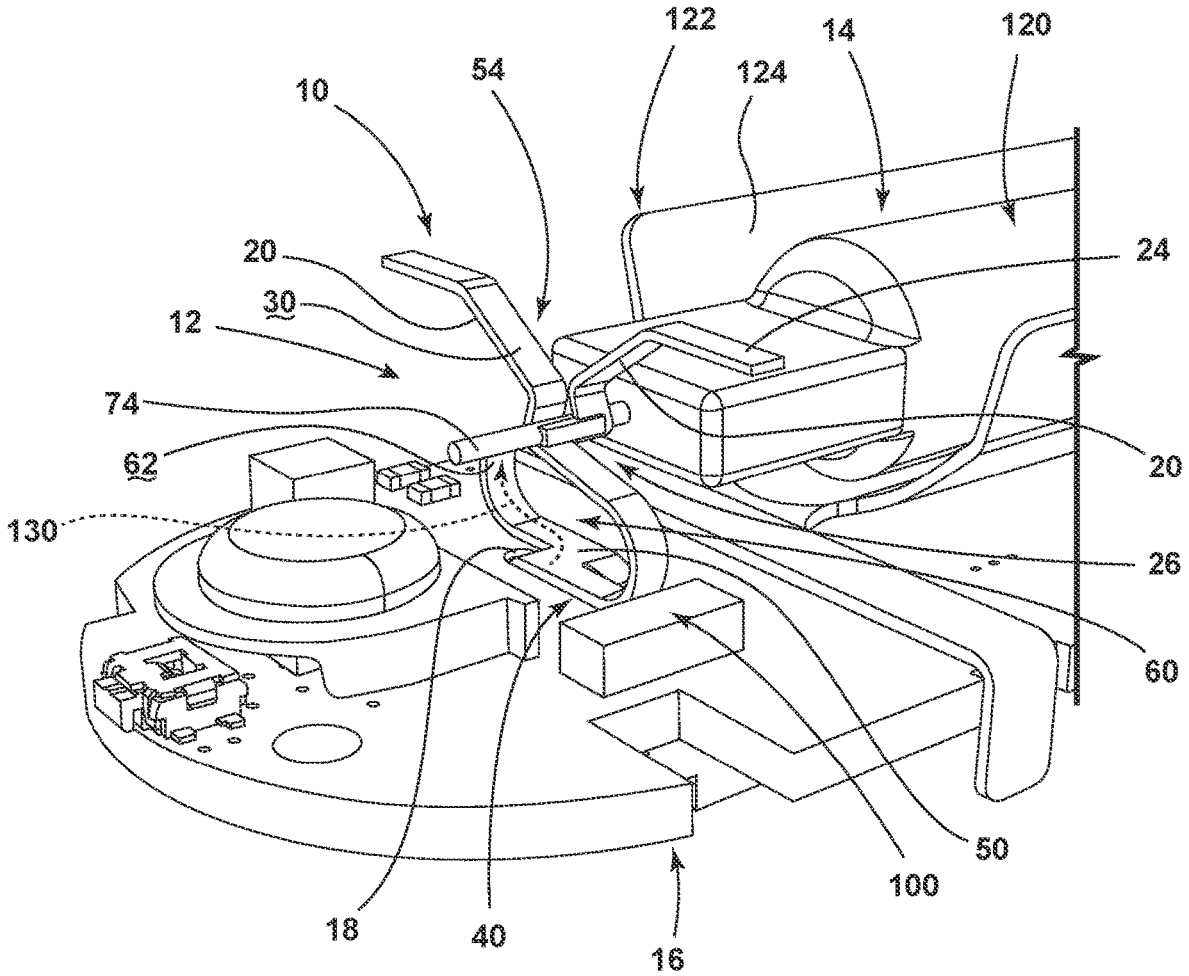
FIG. 1 is a side perspective view of an aspect of the device with an electrical element disposed therein.
Figure 2:
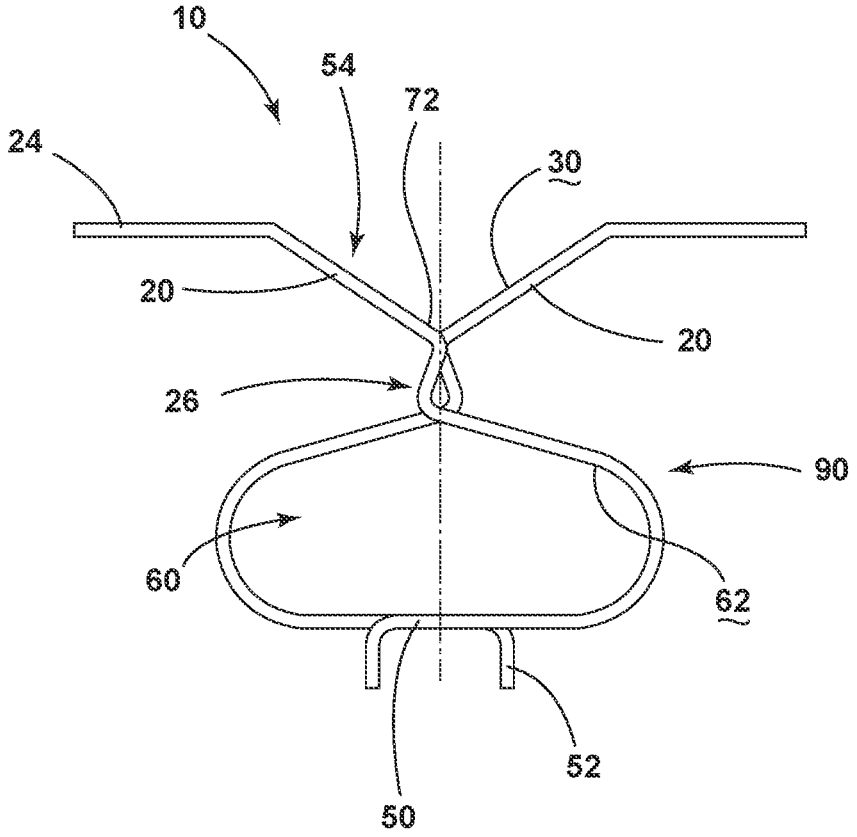
FIG. 2 is an elevational view of an aspect of the resilient holder.
Figure 3:
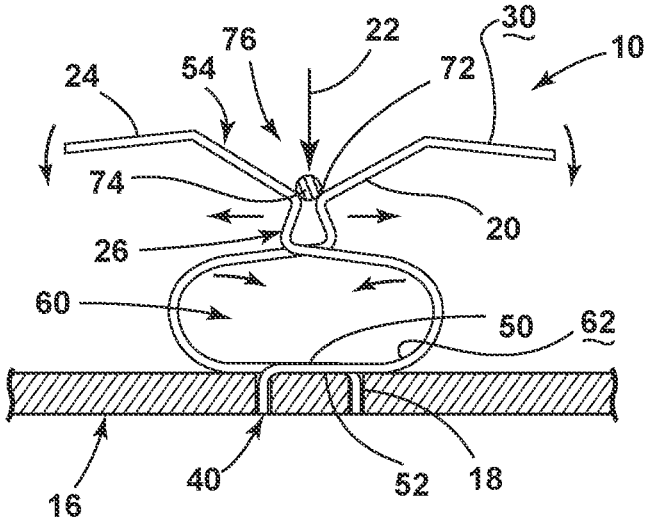
FIG. 3 is a cross-sectional view of an aspect of the holder illustrating the process of positioning the electrical element within the holding portion of the resilient holder.
Figure 4:
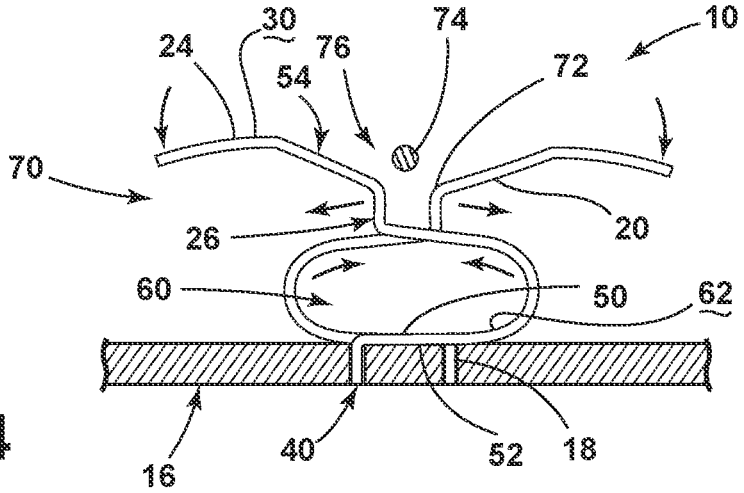
FIG. 4 is a cross-sectional view of an aspect of the holder of FIG. 3 moved into a maintenance position.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to an electrical connector that operates as a holder for attaching an electrical element to a printed circuit board. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring now to FIGS. 1-5, reference numeral 10 generally refers to a resilient holder for an electrical connector 12, such as an electrical element 14. The resilient holder 10 is used for electrically connecting an electrical element 14 or electrical fixture to a printed circuit board 16 (PCB 16). According to various aspects of the device, the electrical connector 12 includes a PCB 16 that includes at least one receiver 18. The resilient holder 10 is electrically engaged with the receiver 18. The resilient holder 10 includes a holding portion 26 that is positioned on an outward surface 30 of the resilient holder 10 and between opposing resilient arms 20 of the resilient holder 10. The electrical element 14 is configured to be secured within the holding portion 26 between the opposing resilient arms 20. The opposing resilient arms 20 are configured such that a retaining biasing force 22 applied to the electrical element 14 toward the PCB 16 is sufficient to bias the opposing resilient arms 20 apart from one another to allow for installation of the electrical element 14 between the opposing resilient arms 20 and within the holding portion 26. Additionally, in situations where the electrical element 14 is to be removed from the resilient holder 10, biasing sections 24 of the opposing resilient arms 20 can be pressed or otherwise biased toward the PCB 16, typically away from one another. This motion expands or enlarges the holding portion 26 to allow the electrical element 14 to be easily removed, released or separated from an engagement with the resilient holder 10. This operation of the electrical element 14 being installed within and removed from the holding portion 26 is configured to be accomplished without the use of additional fasteners, adapters or intermediary connections.

As exemplified in FIGS. 1 and 3-5, the resilient holder 10 is placed within the receiver 18 of the PCB 16. This connection is secured through soldered connections 40 along the surface mount technology (SMT) lines that are applied to define at least a portion of the circuitry of the PCB 16. In particular, the electrical connection to the receiver 18 of the PCB 16 can be performed during the mass production SMT process. Accordingly, the connection of the resilient holder 10 to the receiver 18 of the PCB 16 can be accomplished quickly and efficiently. Using the soldered connections 40 to attach the resilient holder 10 to the PCB 16, additional mechanical fasteners or adapters are not necessary for attaching the resilient holder 10 to the PCB 16. In turn, using the resilient holder 10, the electrical element 14 can be physically secured to the PCB 16 and also electrically connected to the PCB 16 via the resilient holder 10. Again, this direct attachment and electrical connection of the electrical element 14 is accomplished without the need for additional fasteners or adapters.

Referring again to FIGS. 1-5, the resilient holder 10 for the electrical element 14 includes the PCB 16 having the element receptacle 122. Opposing resilient holders 10 are positioned at each end of the element receptacle 122. Each of the opposing resilient holders 10 is electrically attached with the PCB 16 at respective receivers 18 of the PCB 16. Each resilient holder 10 of the opposing resilient holders 10 includes a holding portion 26 defined within an outward surface 30 of the opposing resilient arms 20 for each resilient holder 10. The holding portion 26 is further defined between the opposing resilient arms 20 for each resilient holder 10. An electrical element 14 is secured within the holding portion 26 between the opposing resilient arms 20 for each resilient holder 10. The opposing resilient arms 20 at the holding portion 26 selectively receives the electrical element 14 and prevents movement of the electrical element 14 below the holding portion 26. Each resilient holder 10 of the opposing resilient holders 10 includes a respective common base 50. The opposing resilient arms 20 for each resilient holder 10 extend from the respective common base 50 that engages the receiver 18. Through this configuration, the opposing resilient holders 10 define an electrical contact that extends between the PCB 16 and the contact probes 74 for the electrical element 14. In configurations that include the opposing resilient holders 10, the opposing resilient arms 20 for each resilient holder 10 are similar to the configurations described herein that define the biasing space 60, the holding portion 26, and the receiving area 54 that is above the holding portion 26.

Referring again to FIGS. 1-5, the PCB 16 can include the receiver 18. The resilient holder 10 is electrically engaged with a portion of the receiver 18. The resilient holder 10 includes a holding portion 26 that is defined within the outward surface 30 of the resilient holder 10 and between the opposing resilient arms 20. The inward surface 62 defines the biasing space 60 such that the opposing resilient arms 20 encircle the biasing space 60 and also form the holding portion 26 proximate the area where the opposing resilient arms 20 cross one another. The electrical element 14 is secured within the holding portion 26 between the opposing resilient arms 20. The opposing resilient arms 20 operate to selectively expand the holding portion 26 from a rest position 90 to a maintenance position 70. The opposing resilient arms 20 encircle the biasing space 60 in each of the rest and maintenance positions 90, 70. As discussed herein, the opposing resilient arms 20 extend from the common base 50 that engages with the receiver 18 of the PCB 16 and extend upward to encircle the biasing space 60. The opposing resilient arms 20 then cross at the holding portion 26 and also form the receiving area 54 that is positioned above the holding portion 26. When the electrical element 14 is disposed within the holding portion 26, the opposing resilient arms 20 define the securing position 100 that is configured to be between the rest position 90 and the maintenance position 70 of the opposing resilient arms 20. The opposing resilient arms 20 in the securing position 100 exert the retaining biasing force 22 against the electrical element 14 to secure the electrical element 14 within the holding portion 26 of the resilient holder 10.

Referring again to FIGS. 1-5, the opposing resilient arms 20 of the resilient holder 10 extend from a common base 50. This common base 50 includes one or more contact sections 52 that extend into the receiver 18 of the PCB 16 and are secured thereto via soldered connections 40. From this common base 50, the opposing resilient arms 20 extend upward to encircle a biasing space 60 defined by an inward surface 62 of the resilient holder 10. The opposing resilient arms 20 extend further away from the common base 50 and cross one another to form the holding portion 26 of the resilient holder 10. The shape of the opposing resilient arms 20 forms a receiving area 54 above the opposing resilient arms 20 and above the holding portion 26. When the electrical element 14 is placed within the receiving area 54 and pressed downward onto the outward surface 30 using the biasing force 22, the opposing resilient arms 20 extend apart from one another at the holding portion 26. The areas of the opposing resilient arms 20 between the base 50 and the holding portion 26 that form the biasing space 60 operate toward one another during application of the biasing force 22. In this manner, the opposing resilient arms 20 extend toward one another such that the opposing resilient arms 20 remain crossed with one another and no space is formed below the holding portion 26. Accordingly, the opposing resilient arms 20 at the holding portion 26 selectively receive the electrical element 14 and prevent movement of the electrical element 14 below the holding portion 26. With this configuration, the electrical component is supported by the opposing resilient arms 20 and cannot be pressed through the holding portion 26 and into the biasing space 60 toward the PCB 16.

Referring again to FIGS. 1-5, this configuration of the opposing resilient arms 20 acts as a feedback mechanism during installation of the electrical element 14. During installation of the electrical element 14, the downward biasing force 22 of the electrical element 14 separates the opposing resilient arms 20 to define a maintenance position 70. The opposing resilient arms 20 form a detent portion 72 above the holding portion 26. As a contact probe 74 of the electrical element 14 passes from the receiving area 54, the contact probe 74 moves through the detent portion 72 and extends into the holding portion 26. During this installing motion 76 of the contact probe 74 for the electrical element 14, a snapping-type engagement is experienced by the installer. Again, because the opposing resilient arms 20 between the holding portion 26 and the base 50 are biased toward one another, the contact probe 74 of the electrical element 14 is unable to move beyond the holding portion 26. Accordingly, once the installer of the electrical element 14 receives feedback in the form of the snapping engagement, which is at least partially generated by the detent portion 72, installation of the electrical element 14 is confirmed. This feedback is typically in the form of a tactile feedback, auditory feedback and also visual feedback. Using this tactile feedback mechanism, the electrical element 14 can only be depressed a certain distance before it is stopped by the crossing of the opposing resilient arms 20 at the holding portion 26. All three types of feedback are useful depending upon the accessibility of the PCB 16 during installation and removal of the electrical component from the PCB 16.

Referring again to FIGS. 1-5, the opposing resilient arms 20 are typically made of a spring metal that is resilient and is biased toward a rest position 90. In certain aspects of the device, it is contemplated that one of the opposing resilient arms 20 may be configured to deflect more easily than the other such that the opposing resilient arms 20 may be defined by one of the opposing resilient arms 20 having a greater structural integrity than the other of the opposing resilient arms 20. Typically, the opposing resilient arms 20 will be made of a consistent thickness such that each of the opposing resilient arms 20 has a consistent resilient flexibility toward the rest position 90 of the resilient holder 10.

Referring again to FIGS. 1-5, the opposing resilient arms 20 are biased toward the rest position 90 of the opposing resilient arms 20. In this configuration, the opposing resilient arms 20 define the receiving area 54. In addition, the rest position 90 of the opposing resilient arms 20 typically defines the holding portion 26 between the opposing resilient arms 20. As discussed above, each of the opposing resilient arms 20 includes a biasing section 24 that is configured to be pressed toward the PCB 16, and typically away from one another. Movement of these biasing sections 24 of the opposing resilient arms 20 causes the resilient holder 10 to be moved towards the maintenance position 70. In this maintenance position 70, the detent portion 72 of the opposing resilient arms 20 is separated and the holding portion 26 is enlarged so that the electrical element 14, when installed in the holding portion 26, can be removed from the holding portion 26 of the opposing resilient arms 20.

As discussed previously, and as exemplified in FIGS. 3-5, when the biasing sections 24 of the opposing resilient arms 20 are moved toward the PCB 16, the area of the opposing resilient arms 20 below the holding portion 26 are moved toward one another. This ensures that as the biasing sections 24 of the opposing resilient arms 20 are moved toward the PCB 16, the electrical element 14 does not fall or otherwise move toward the PCB 16. Accordingly, removal of the electrical element 14 from the holding portion 26 can be accomplished by a single operator with one or two hands, and without the use of external tools.

Figure 5:
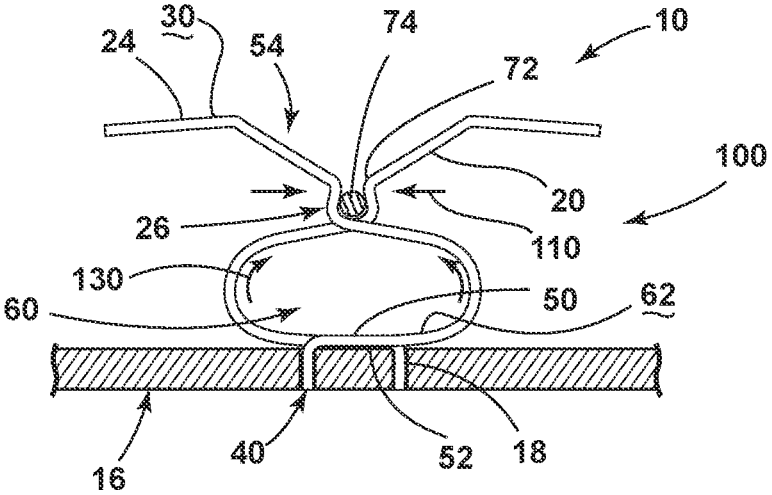
FIG. 5 is a cross-sectional view of an aspect of the holder of FIG. 3 in the securing position with a contact probe of the electrical element in the holding portion.

As exemplified in FIGS. 1 and 5, when the electrical element 14 is disposed within the holding portion 26, the opposing resilient arms 20 define a securing position 100 that is between the rest position 90 and the maintenance position 70 of the opposing resilient arms 20. In this securing positon, the opposing resilient arms 20 at the holding portion 26 are biased toward one another and toward the rest position 90. In this manner, the opposing resilient arms 20 at the holding portion 26 press against the contact probe 74 of the electrical element 14. In this manner, the holding portion 26 tends to surround the contact probe 74 of the electrical element 14 to ensure a consistent and repeatable electrical contact between the electrical element 14, the resilient holder 10 and the PCB 16. The force exerted at the holding portion 26 against the contact probe 74 can be described as a retaining force 110 that is exerted by the opposing resilient arms 20 against the contact probe 74 of the electrical element 14.

Referring again to FIGS. 1-5, the opposing resilient arms 20 of the resilient holder 10 each include contoured configurations that extend from the base 50, through the holding portion 26 and to the biasing section 24. The various spaces that are defined by the opposing resilient arms 20 can include, but are not limited to, the holding portion 26, the detent portion 72, the receiving area 54, the biasing section 24, and other similar spaces that are defined within and around the opposing resilient arms 20. As discussed above, when the opposing resilient arms 20 are in the rest position 90, a receiving area 54 is defined above the holding portion 26. This receiving area 54 can be configured to taper toward the detent portion 72 and the holding portion 26 such that the electrical contact can be easily located within the receiving area 54 and the biasing force 22 can be applied in an efficient manner to install the electrical element 14. Again, this downward biasing force 22 applied to the electrical element 14 causes the opposing resilient arms 20 to bias away from one another to achieve the snapping engagement of the contact probe 74 of the electrical element 14 within the holding portion 26.

According to various aspects of the device, the use of the opposing resilient arms 20 of the resilient holder 10 achieve a convenient pushdown installation of the electrical element 14 within the resilient holder 10. In addition, the resilient holder 10 is configured to be surface mounted using soldered connections 40 at the contact sections 52 of the resilient holder 10 to the PCB 16. Through this configuration, no mechanical fasteners or adapters are required to attach the resilient holder 10 to the PCB 16 or to attach the electrical element 14 to the resilient holder 10. In addition, the configuration of the resilient holder 10 within the PCB 16 provides for efficient installation and serviceability of the various components of the PCB 16. By way of example, and not limitation, the electrical element 14 can be easily installed and removed without the need for additional tools and by a single operator. In addition, if the opposing resilient arms 20 of the resilient holder 10 tend to wear out or require servicing, the resilient holder 10 can be easily removed and another soldered connection 40 applied to the PCB 16 to extend the life of the various components of the PCB 16 and the resilient holder 10.

According to various aspects of the device, as exemplified in FIG. 1, the electrical element 14 is typically in the form of a light fixture 120 or lighting element having contact probes 74 at each end of the light fixture 120. In such an aspect of the device, the PCB 16 includes two opposing resilient holders 10 that are positioned at each end of an element receptacle 122 of the PCB 16. The opposing resilient holders 10 are positioned to receive the opposing contact probes 74 of the lighting element. The opposing resilient holders 10 are attached to the PCB 16 and provide electrical communication between the PCB and the light fixture 120 via the opposing resilient holders 10. The element receptacle 122 of the PCB 16 can also include certain dedicated structures that receive certain aspects of the electrical element 14. By way of example and not limitation, the element receptacle 122 that receives a light fixture 120 can include certain reflective structures 124 that are attached to the PCB 16. These reflective structures 124 of the element receptacle 122 can include a reflective surface in the form of a parabolic enclosure or other reflective surface that is used to maximize the output of illumination from the lighting element in a particular direction. While only one side of the PCB 16 and the electrical element 14 is shown in FIG. 1, it is contemplated that where opposing resilient holders 10 are used to secure and attach the electrical element 14, the pair of opposing resilient holders 10 are similar in shape, construction and operation with respect to the PCB 16 and the electrical element 14.

It is also contemplated that the electrical element 14 can be in the form of other fixtures and circuitry components. These circuitry components can be in the form of capacitors, resistors, transistors, sensors, and other similar circuitry components and electrical components that may be attached to a PCB 16.

According to various aspects of the device, the electrical connector 12 that includes the PCB 16 and the resilient holder 10 can be used within various settings. Such settings can include, but are not limited to, vehicles, electrical controls, fixtures, household components, commercial components, combinations thereof, and other similar settings and conditions.

While a single resilient holder 10 is exemplified in FIG. 1, it is contemplated that a separate resilient holder 10 can be used for each contact probe 74 that is included within the electrical element 14. The configuration and positioning of the various electrical holders within the PCB 16 can vary depending upon the electrical element 14 to be disposed and electrically connected to the PCB 16.

It should be understood that the use of the resilient holder 10 is used to physically position an electrical element 14 with respect to the PCB 16. The resilient holder 10 is also used to provide an electrical contact that allows an electrical current 130 to be delivered from the PCB 16, to the electrical element 14, and from the electrical element 14 back to the PCB 16, to complete a circuit for operating the electrical element 14.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. An electrical element holder comprising:

a printed circuit board having a receiver;

a resilient holder electrically engaged with the receiver, the resilient holder having a holding portion that is defined within an outward surface of the resilient holder and between opposing resilient arms that cross at an intersection to form a continuous lower boundary of the holding portion, wherein the opposing resilient arms define a detent portion that forms an upper boundary of the holding portion, and wherein the intersection and the detent portion encircles the holding portion in a rest position of the resilient holder; and an electrical element secured within the holding portion between the opposing resilient arms and against the intersection and the detent portion, wherein the opposing resilient arms at the holding portion at least partially encircles a contact probe of the electrical element and supports the electrical element from below.

2. The electrical element holder of claim 1, wherein the opposing resilient arms extends from a common base that engages the receiver.

3. The electrical element holder of claim 1, wherein the resilient holder defines an electrical contact that extends between the printed circuit board and the electrical element.

4. The electrical element holder of claim 1, wherein the electrical element is a lighting element.

5. The electrical element holder of claim 2, wherein the opposing resilient arms are biased toward one another to define the rest position, and wherein the opposing resilient arms are configured to be biased in opposing directions to define a maintenance position that expands the holding portion.

6. The electrical element holder of claim 5, wherein the contact probe of the electrical element is able to be released from the opposing resilient arms in the maintenance position.

7. The electrical element holder of claim 5, wherein when the contact probe of the electrical element is disposed within the holding portion, the opposing resilient arms define a securing position that is between the rest position and the maintenance position.

8. The electrical element holder of claim 7, wherein the opposing resilient arms in the securing position exert a retaining biasing force against the contact probe of the electrical element.

9. The electrical element holder of claim 5, wherein the opposing resilient arms each include a contoured configuration that extends from the common base, through the holding portion defined by the detent portion and the intersection and to biasing sections that extend laterally outward from a receiving area defined above the detent portion.

10. The electrical element holder of claim 9, wherein the biasing sections of the opposing resilient arms are operated toward the printed circuit board to expand the holding portion to the maintenance position.

11. An electrical element holder comprising:

a printed circuit board having an element receptacle;

opposing resilient holders positioned at each end of the element receptacle, wherein each of the opposing resilient holders is electrically attached with the printed circuit board at respective receivers, each resilient holder of the opposing resilient holders includes a holding portion defined within an outward surface of opposing resilient arms of each resilient holder, and wherein the holding portion is further defined between the opposing resilient arms, wherein the opposing resilient arms cross at an intersection to form a continuous lower boundary of the holding portion and extend to a detent portion that encloses the holding portion in a rest position of the opposing resilient arms; and an electrical element secured within the holding portion between the opposing resilient arms and between the detent portion and the intersection for each resilient holder, wherein the opposing resilient arms at the holding portion selectively receive the electrical element and prevent movement of the electrical element below the holding portion, and wherein the electrical element secured in the holding portion is supported from below by the opposing resilient arms for each resilient holder.

12. The electrical element holder of claim 11, wherein each resilient holder of the opposing resilient holders includes a respective common base, wherein the opposing resilient arms for each resilient holder extend from the respective common base and extend through the intersection that engages the receiver.

13. The electrical element holder of claim 11, wherein the resilient holder defines an electrical contact that extends between the printed circuit board and the electrical element.

14. The electrical element holder of claim 12, wherein the opposing resilient arms each include a contoured configuration that extends from the respective common base, through the intersection and the detent portion of the holding portion and to biasing sections that extend laterally outward from a receiving area defined above the detent portion.

15. The electrical element holder of claim 14, wherein the biasing sections of the opposing resilient arms are operated toward the printed circuit board to expand the holding portion to a maintenance position.

16. An element receptacle comprising:

a printed circuit board having a receiver;

a resilient holder electrically engaged with a portion of the receiver, the resilient holder having a holding portion that is defined within an outward surface of the resilient holder and between opposing resilient arms that cross at an intersection to form a lower boundary of the holding portion and extend upward to a detent portion that forms an upper boundary of the holding portion at least in a rest position of the opposing resilient arms, wherein an inward surface defines a biasing space; and an electrical element secured within the holding portion between the opposing resilient arms, wherein the opposing resilient arms operate to selectively expand the holding portion from the rest position to a maintenance position, wherein the opposing resilient arms encircle the biasing space and the intersection defines a continuous boundary that separates the holding portion from the biasing space in each of the rest position and the maintenance position, and wherein the detent portion in the rest position separates the holding portion from a receiving area defined above the holding portion.

17. The element receptacle of claim 16, wherein the opposing resilient arms extend from a common base and extends to the intersection that engages the receiver.

18. The element receptacle of claim 16, wherein the opposing resilient arms are biased toward one another to define the rest position, and wherein the opposing resilient arms are configured to be biased in opposing directions to define the maintenance position that expands the holding portion, wherein the electrical element is able to be released from the opposing resilient arms in the maintenance position.

19. The element receptacle of claim 16, wherein when the electrical element is disposed within the holding portion, the opposing resilient arms define a securing position that is between the rest position and the maintenance position, wherein the opposing resilient arms in the securing position exert a retaining biasing force against the electrical element.

20. The element receptacle of claim 17, wherein the opposing resilient arms each include a contoured configuration that extends from the common base, around the biasing space, through the intersection and the holding portion and to a biasing section that extends laterally outward from the receiving area defined above the detent portion.

* * * * *